US005138732A

United States Patent [19]

Wattie et al.

[11] Patent Number: 5,138,732

[45] Date of Patent: Aug. 18, 1992

[54] PILLOWS

[75] Inventors: James A. Wattie; Joanna M. Wattie, both of Leicester, Great Britain

[73] Assignee: National Research Development Corporation, London, England

[21] Appl. No.: 562,903

[22] Filed: Aug. 6, 1990

[30] Foreign Application Priority Data

Nov. 17, 1989 [GB] United Kingdom ..... 8926022

[51] Int. Cl.[5] ..... A47C 20/02

[52] U.S. Cl. ..... 5/636

[58] Field of Search ..... 5/434, 436, 441, 636

[56] References Cited

U.S. PATENT DOCUMENTS

| | | | |
|---|---|---|---|
| 3,388,408 | 6/1968 | Blaney | 5/436 |
| 3,394,414 | 7/1968 | Unger | 5/434 |
| 4,731,891 | 3/1988 | Scheurer et al. | 5/434 |
| 4,850,068 | 7/1989 | Walpin et al. | 5/434 |
| 4,899,405 | 2/1990 | Rothbard | 5/434 |
| 4,918,774 | 4/1990 | Popitz | 5/434 |

FOREIGN PATENT DOCUMENTS

| | | | |
|---|---|---|---|
| 270014 | 6/1988 | European Pat. Off. | 5/434 |
| 101524 | 11/1981 | Fed. Rep. of Germany | 5/434 |
| 999217 | 7/1964 | United Kingdom . | |
| 1216012 | 2/1968 | United Kingdom . | |
| 1273259 | 12/1969 | United Kingdom . | |
| 1299789 | 5/1970 | United Kingdom . | |
| 2212391 | 7/1989 | United Kingdom | 5/434 |
| 2228192 | 12/1989 | United Kingdom . | |

*Primary Examiner*—Renee S. Luebke
*Assistant Examiner*—Michael J. Milano
*Attorney, Agent, or Firm*—Cushman, Darby & Cushman

[57] ABSTRACT

A pillow is of rectangular form and formed by adhering together a top part and base part, the top part being of a softer material than that of the base part. The base part has front and rear rolls at its longer sides and side rolls at its shorter sides, upper and lower surfaces of the pillow having respective large, central recessed areas between the front and rear rolls, the rolls being interrupted by minor recesses extending from respective sides of the pillow into the central recessed areas of the upper and lower surfaces respectively, the front and rear rolls forming on each surface a central main buttress and together with the side rolls forming four corner buttresses, side buttresses also being formed between pairs of adjacent corner buttresses respectively, the side buttresses tapering in width and height away from their respective associated sides of the pillow into a central recessed area. The whole of the upper surface of the top part is smooth and its lower surface is adhered to the upper surface of the top part only around their respective perimeters. A large, central void space is defined between the top and base parts in an undeformed state of the pillow.

21 Claims, 5 Drawing Sheets

PILLOWS

This invention relates to improvements in or relating to pillows, particularly pillows formed of deformable moulded rubber or plastics material, and has as its object the provision of a pillow in a convenient and effective form. As used herein, the word 'pillow' includes analogous items, such as cushions.

According to the invention there is provided a pillow comprising a base part and a top part, the base part having respective front and rear rolls, and an upper surface with a large central recessed area between the rolls, the top part having a lower surface adhered to said upper surface of the base part so that in an undeformed state of the pillow there is a central void between said base part and the upper surface of the top part, the whole of an upper surface of the top part being smooth, and the top part being of a softer material than that of the base part.

The term 'large' is used in comparison in surface area with the area of load (head) applied to said upper surface, in use.

Preferably the base part is symmetrical about a mid-plane through said front and rear rolls and in the direction of extent of said rolls.

Conveniently the top part is of soft latex material and is adhered to the base part only around its perimeter.

Figure 1A:
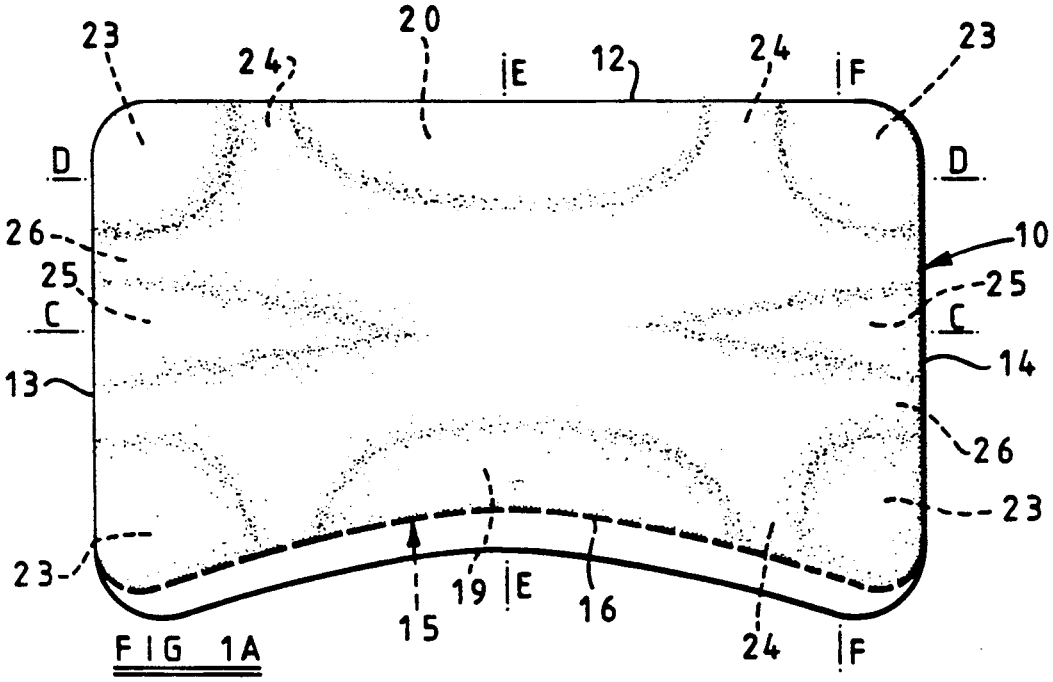
Figure 1B:
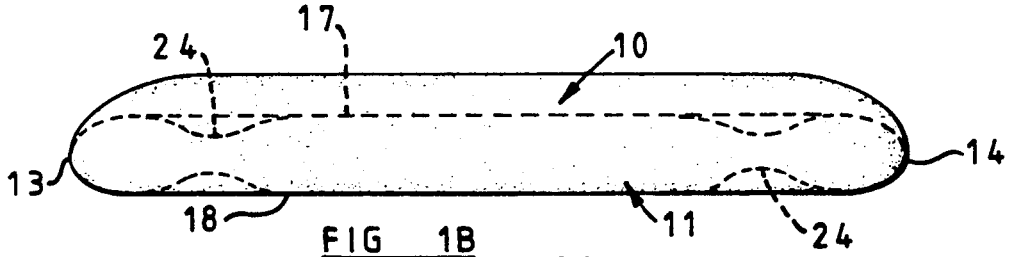
Figure 1C:
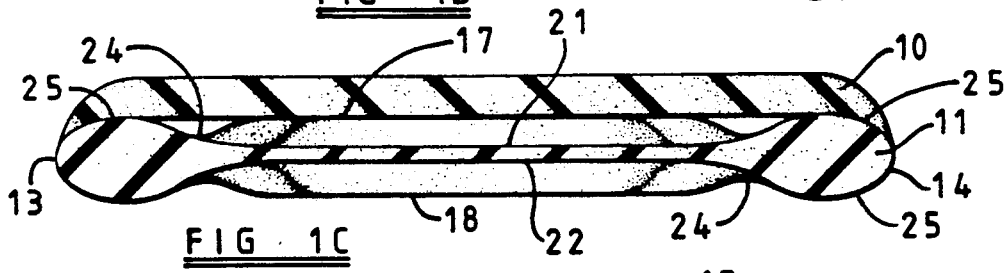
Figure 1D:
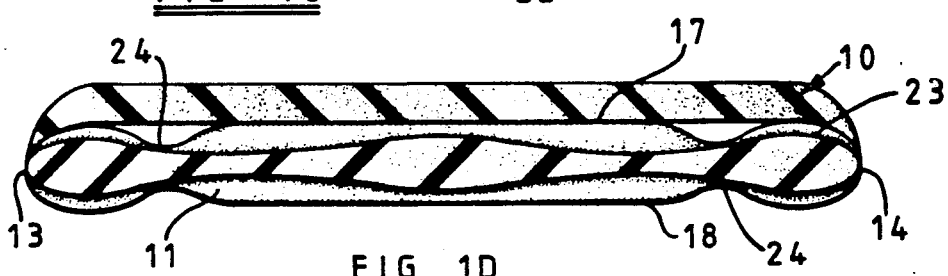
Figure 1E:
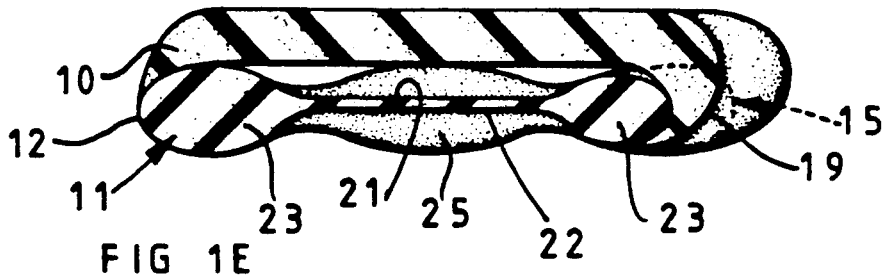
Figure 1F:
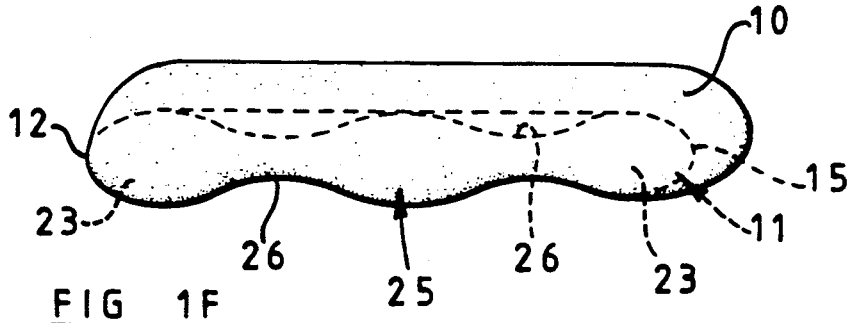
Figure 2A:
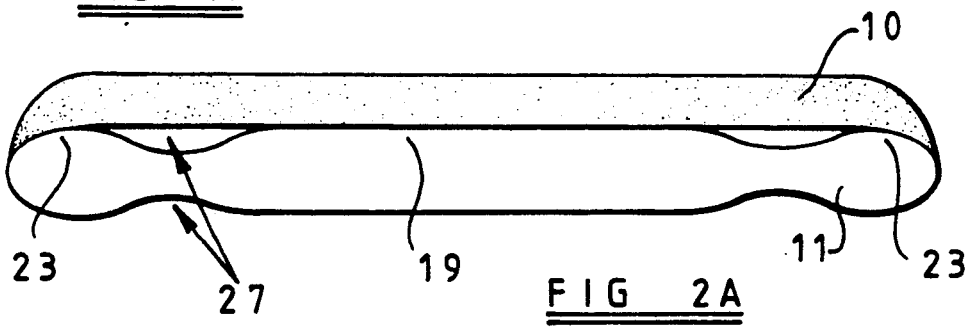
Figure 2B:
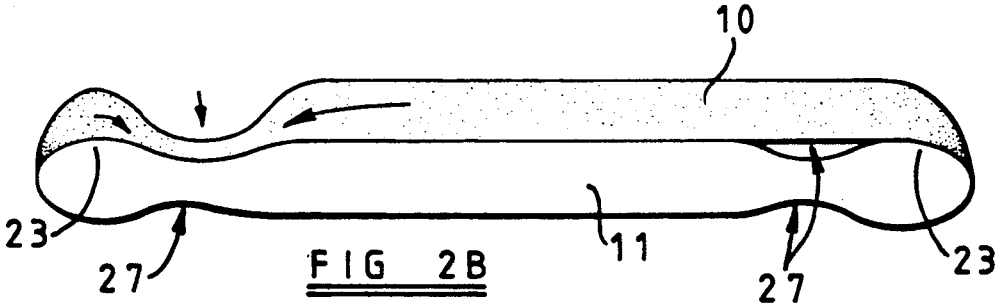
Figure 2C:
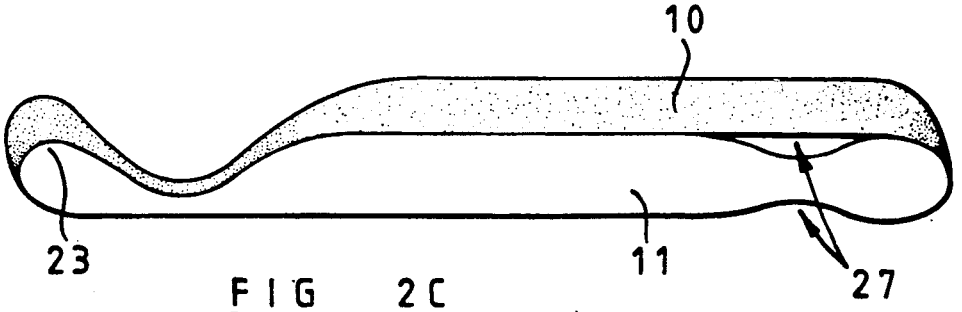
Figure 2D:
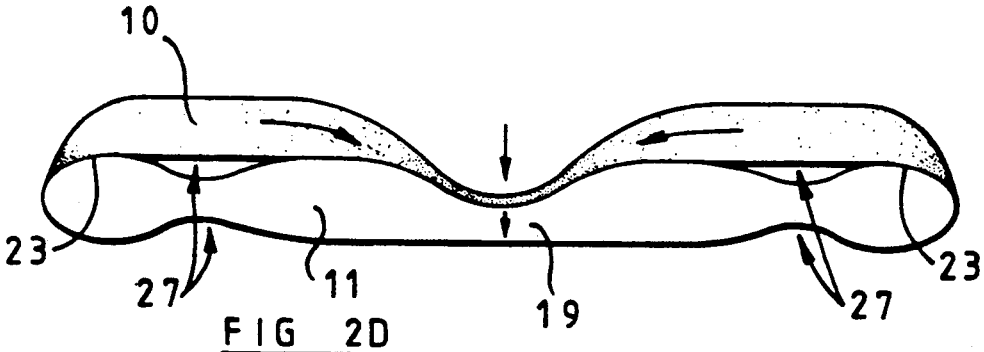
Figure 3A:
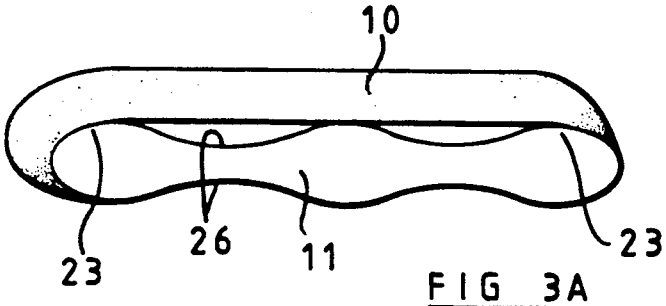
Figure 3B:
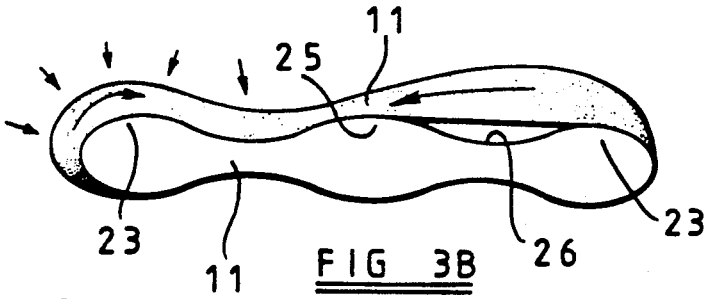
Figure 3C:
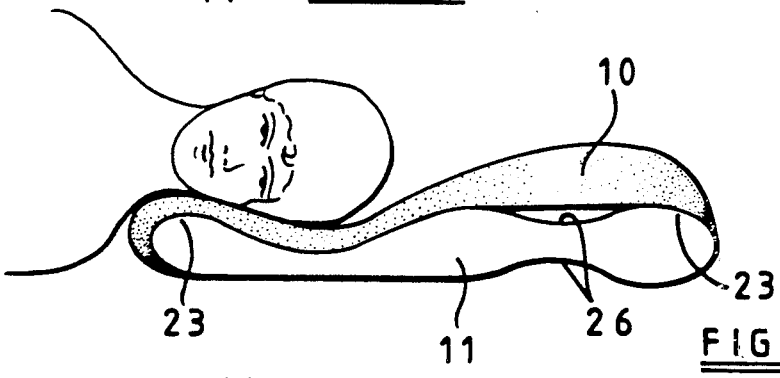
Figure 4A:
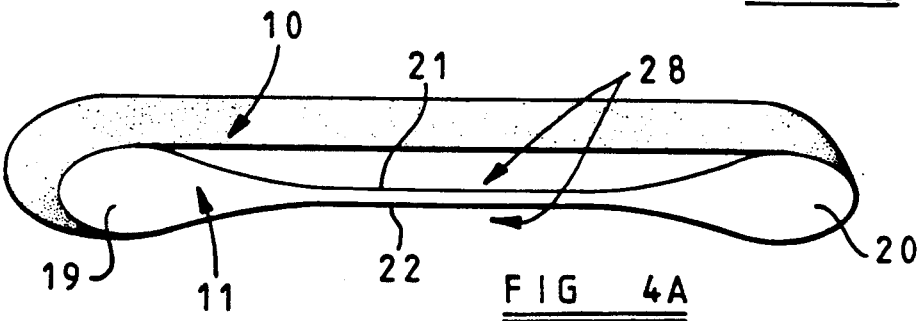
Figure 4B:
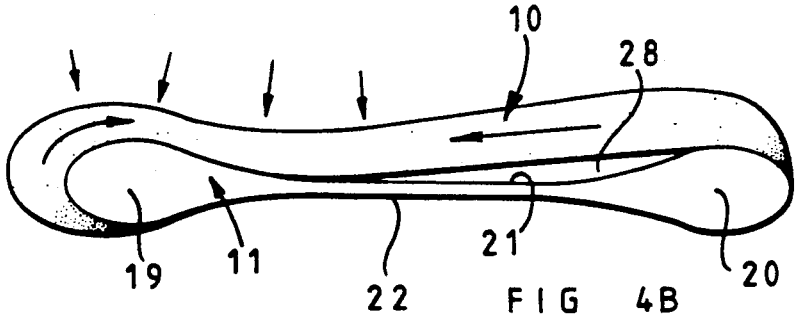
Figure 4C:
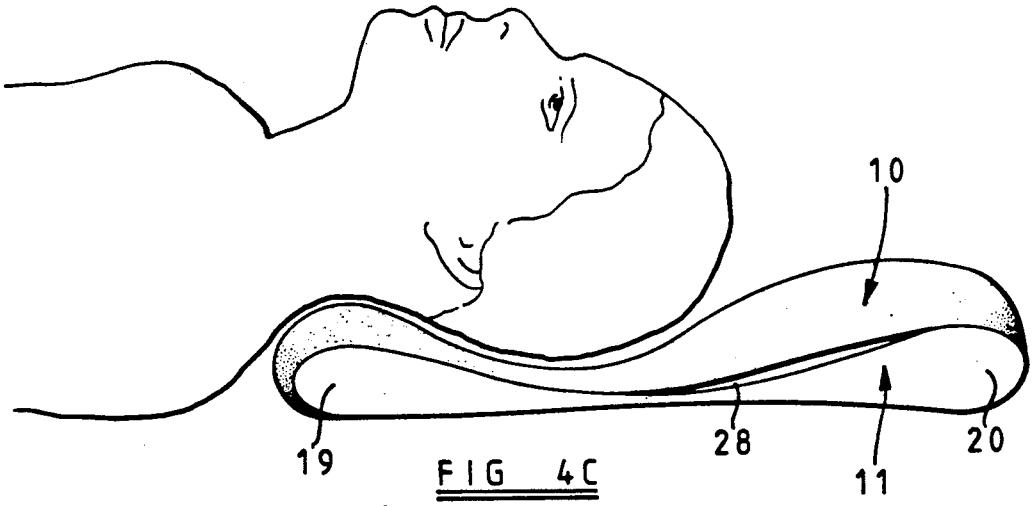
Figure 5A:
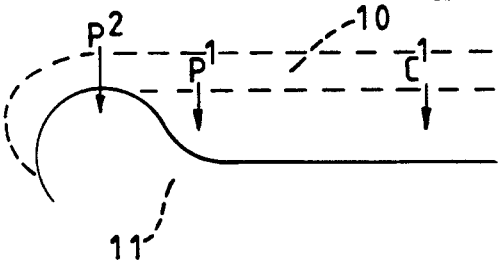
Figure 5C:
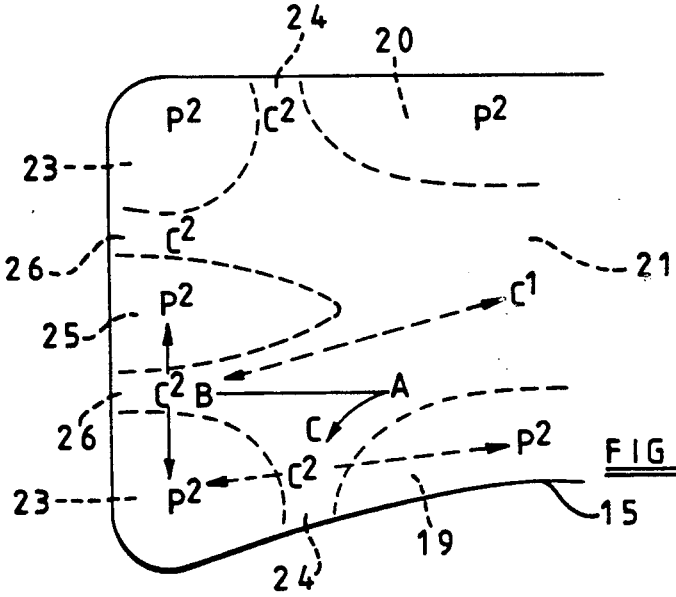
Figure 5B:
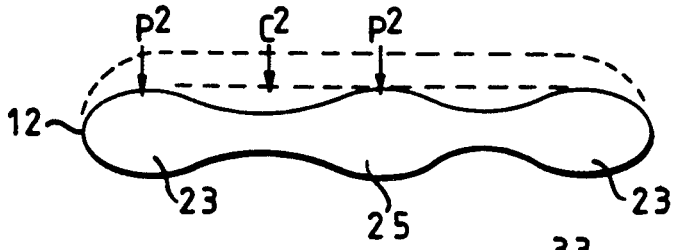
Figure 6A:
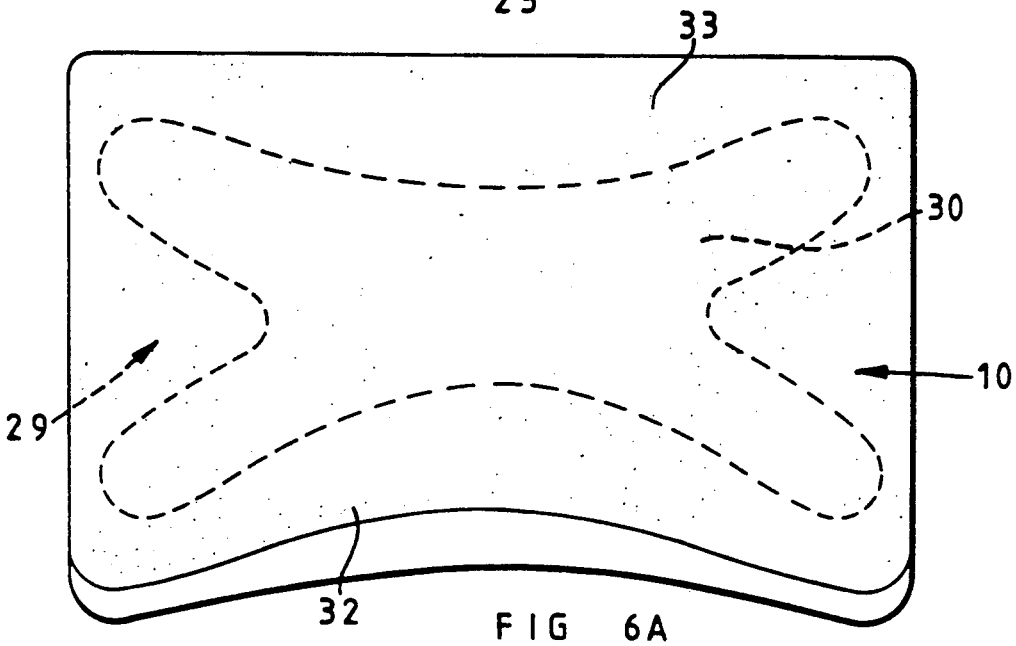
Figure 6B:
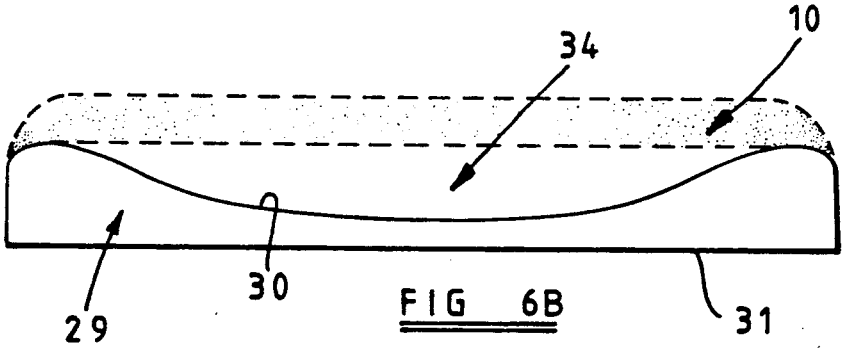
Figure 6C:
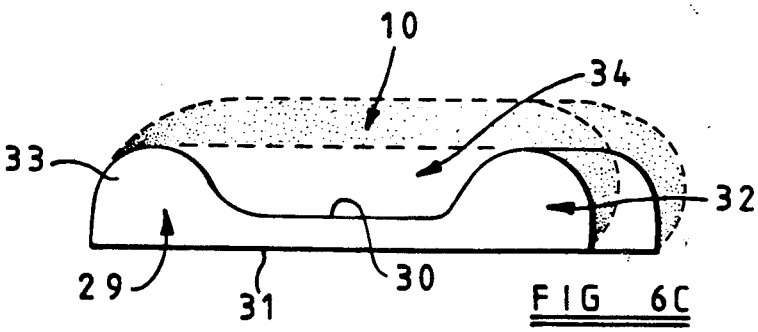

The invention will now be described, by way of example, with reference to the accompanying drawings, in which:

FIG. 1A is a generally schematic top plan view of a pillow of the invention, but with the outline of the upper surface of a base part of the pillow also shown, FIG. 1B is a schematic longitudinal, front view of the pillow, FIGS. 1C, 1D and 1E are respective schematic cross-sectional views on the lines C—C, D—D and E—E of FIG. 1A, FIG. 1F is a schematic side view of the pillow, FIG. 2A, 2B, 2C and 2D are respective schematic front views at four successive stages of stress applied to the pillow, FIGS. 3A, 3B and 3C are respective schematic cross-sections on the line F—F of FIG. 1 of three successive stages of stress applied to the pillow, starting with the unstressed stage, FIGS. 4A, 4B and 4C are respective, schematic cross-sections on the line E—E of FIG. 1 for three successive stages of stress applied to the pillow, starting with the unstressed stage, FIG. 5A is a diagram at line E—E showing loads applied at different positions along a top part of the pillow, FIG. 5B is a further diagram at line F—F showing loads applied to said top part of the pillow, FIG. 5C is a fragmentary view of the upper surface of the base part of the pillow showing the various areas defined thereon, and FIGS. 6A, 6B and 6C are respective schematic plan, front and side views of an alternative form of pillow of the invention.

The pillow of the first embodiment of the invention (FIGS. 1 to 5) is formed in two parts, namely a soft top pad layer or top part 10, and an underpillow or base part 11 of a more rigid material composition. The two parts are adhered to one another, as will be described, and the resultant composite pillow is intended for use as a conventional pillow on which a user's head is directly received.

From FIGS. 1A-1F, it can be seen that the base part 11 is of generally rectangular shape in plan, having a straight rear edge or surface 12, shorter straight transverse edges or surfaces 13, 14 respectively, and a front edge or surface 15 which is concave to define a bight 16. The depth of the base part is reduced compared to that of a conventional one-piece top pillow. The base part has generally flat, parallel upper and lower surfaces 17, 18. It is made of soft polyurethane or latex, for example, and is rigid/firmer than the top part 10.

In alternative constructions, the front and rear surfaces could both be straight, or both concave and also one or both of the surfaces 17, 18 could be slightly concave.

The base part has respective front and rear rolls 19, 20, and also side rolls, of generally ovoid shape, i.e. with generally flattened upper and lower surfaces. Respective, identical, central concave major recesses 21, 22 are formed in the upper and lower surfaces, and the base part is in fact symmetrical about a plane mid-way through it and parallel to its upper and lower surfaces, i.e., through the front and rear rolls. The recesses thus overlie one another in a direction normal to the surfaces 17, 18. Alternatively, the base part can be slightly asymmetric.

The front and rear rolls terminate short of the shorter sides of the base part, each roll tapering convexly from its mid-point to its ends, as shown in FIG. 1A. This is the case on both surfaces 17, 18. Similarly on both surfaces 17, 18, four major buttresses 23 are provided at the four corners of the base part respectively, each buttress being convexly curved at its inner boundary in plan view, as shown in FIG. 1. Each major buttress gently tapers from its apex so as be generally dome-shaped. The central parts of the rolls 19, 20 form first and second buttress portions respectively on both upper and lower base part surfaces, with the upper portions shorter than the lower portions or vice versa, or with the portions equal as shown.

Between each major buttress and an adjacent front or rear roll is a minor recess 24 which extends from the major recess 21 or 22 to a front or rear surface of the base part. Each recess 24 widens outwardly, i.e. away from the surface of the base part.

Similarly along both shorter sides of the base part, on both its upper and lower surfaces, side buttresses 25 are formed mid-way between the corner or major buttresses. Each side buttress extends inwardly from a side surface, is of generally triangular shape, tapering down away from its side surface, and also towards its adjacent corner buttresses. At its side surface it is at the same level as said corner buttresses, but it slopes towards, and eventually runs into the central major recess 21, or 22. The side buttresses on the lower surface could be less wide than those on the upper surface, thereby making the base part asymmetric about its mid-plane.

Between each side buttress and a corner buttress is a further minor recess 26, of similar form to minor recesses 24, extending from the central major recess 21 or 22 to a side surface of the base part 11.

As described, the base part is of similar form to the underpillow described and illustrated in our published P.C.T. Patent application no. WO 90/06708. However, the present invention relates to a conventional pillow formed by adhering a top part suitably to the base part described.

The top part 10 is preferably produced from soft Talalay type latex foam (pinhole latex material) which may be of uniform thickness or have one surface flat and the other gently convex but otherwise smooth. Its thickness can be varied to suit requirements.

The top part 10 is smooth on the whole of its upper surface and should not require any recesses in its lower surface, particularly where the Talalay type of latex foam is used. (The standard approximately 5 mm pin holes are not considered recesses).

The top part is preferably only adhered to the base part around its periphery. This adherence should not extend centrally beyond the highest points of the rolls and side/corner buttresses. During the adhesion process, the top part is lightly stretched so that its lower surface remains flat when not under any load and parallel to the horizontal plane of the base pad. This creates a relatively large central air filled void, i.e. the major recess 21 leading into the eight upper surface minor recesses. The top part 10 is extended over the front roll 19 as best shown in FIGS. 1E and 1F. It can also be extended over the rear roll 20 and/or both side rolls or any combination as required.

The reaction to applied loads of the various parts of the base part, of the top part, and then the complete pillow will now be described.

The recesses of the base part are concerned with supporting loads perpendicular to the horizontal plane of the pillow, and in addition loads acting and moving in planes parallel to the plane of the pillow. A single, central major recess with eight peripheral minor recesses is provided in each of the upper and lower surfaces of the base part. These recesses are concerned with load support and transfer across surface planes of the pillow in conjunction with the top part.

The major recesses 21, 22 gradually reduce in depth towards the front and rear rolls and also towards the lateral sides of the base part by virtue of the varying cross-sectional shape of the central pad of the base part. The major recesses lead into the minor recesses by relatively wide openings which narrow progressively towards the peripheral part of each minor recess in the horizontal plane and also in the vertical plane (due to progressive thickening of in the floor of opposing upper and lower surface minor recesses towards the periphery). Both major and minor recesses progressively widen away from the surface plane of the base part, i.e. they are upwardly (outwardly) widening.

All upper and lower surface recesses narrow towards each other, i.e. towards the horizontal mid plane of the base part. The minor recesses between buttresses and also between rolls and buttresses function synergistically to provide variation in vertical and horizontal load support (cradling) and transfer.

As described previously, the corner and side buttresses have a variable convex shape outwards from the horizontal plane of the base part, with a gentle taper towards their apex, to be dome-shaped. They thus provide a gradually variable material counterforce to perpendicular loads moving in a horizontal plane. There is synergism of function between buttresses or a buttress and a roll in conjunction with the recesses. Buttresses are gently spread apart by simultaneous perpendicular and horizontal plane loads, so the head and neck are cradled.

Minor buttresses can be defined between a corner buttress and a side buttress, and between a corner buttress and a roll. Each minor buttress has a gentle outwardly convex shape as the base part pad thickness increases towards the base part periphery. The minor buttresses also work synergistically with the major buttresses and recesses to facilitate cradling and reduce the possibility of the user's head moving beyond the peripheral limits of the pillow in use.

FIG. 5C shows the various regions of the base part discussed above, with $c^1$ denoting the central area of the major recess 21, $c^2$ the central area of the minor recesses 24, 26 and $p^2$ the highest point of a major buttress or roll.

A load moving in the horizontal plane from A to B will encounter progressively increasing vertical and horizontal plane counterforces by virtue of the narrowing of minor recess $c^2$, the main buttresses outline shape and convexity, together with the minor buttress, acting synergistically. Similar counter-forces also act on a load moving in the direction A–C. The possibility of excessive arcuate movements of the head and neck is reduced by the synergistic actions of roll, buttresses and recesses.

Considering a section through a minor recess, e.g. line B-A, there is a gradual increase of 'pad' thickness towards the sides of the base part and also towards the front and rear rolls. This results in base pad counterforces gradually increasing towards the periphery. The major recess areas both have a reducing volume towards both the sides and the front and rear rolls.

The cradling effect of the minor recesses is further enhanced by their opposing configuration. A load applied in the region of an upper surface minor recess will result in depression of the intervening pad and its peripheral portion, viz. the minor buttress, towards the surface of the bed or other supporting surface. Further application of load will result in vertical compression of the pad material itself. The gradual progressive cradling effect of the lower surface minor recess can be further enhanced if it has an asymmetrical shape compared to its opposite surface minor recess. The laterally moving load in such a case has, for example, a relatively greater volume of lower surface minor recess to obliterate, resulting in a more gradual, progressive cradling effect. Similar principles apply to all other recesses, including upper and lower surface major recesses.

The front and rear rolls have a specific shape and function, i.e. the curvature of the front roll/plan view, the straight rear roll and the taper of both rolls from their mid points towards their lateral limits at their junctions with the minor recesses. In plan view the front roll tapers asymmetrically. Only the medial (inner) border of the rear roll tapers. In front elevation the front/rear roll may taper towards its lateral limits symmetrically or asymmetrically.

The rolls provide a progressively reducing counterforce to the head and neck towards their lateral limits, particulary during arcuate movements of the head and neck towards a minor recess. This reducing counterforce is balanced by an increasing counterforce of the centripetal part of the side buttress and then the front buttress. As previously described, cradling of the head and neck occurs by synergism between roll, buttress (front and side) and the minor recesses thus reducing the possibility of the head moving beyond the front or side limits of the pillow, particularly during sound sleep.

With the top part 10 adhered to the base part 11, a load (head) applied to the top part smooth outer surface will initially stretch the pad 10 over its entire surface bounded by the highest points of the rolls and buttresses. The initial load is thus spread over the surface and not confined to a relatively small area immediately in contact with the head. Under further load the soft top immediately below the head depresses to make contact with the base part and now undergoes vertical compression. This occurs along with depression of the base pad towards the bed surface, again by virtue of generally horizontal plane stretching of this firmer type of latex or foam material. Further load results in vertical compression of the base pad. The soft top pad and base pad thus function is a progressive synergistic manner to vertical loads. As it is important to support, but not to restrict horizontal plane movements of the sleeper's head in an undesirable way, the soft top pad should preferably not have recesses on either surface. Similarly the pad comprising the floor of the major recess of the base part should also be relatively smooth.

FIG. 5A shows how counterforce to the head gradually increases towards the pillow periphery in a specific variable manner. A load in the central area of the top part 10 at $c^1$ will result in generally horizontal stretching fairly evenly around the circumference of the head and so evenly distribute the counterforce. A load at $p^1$ results in relatively less stretch of the top part 10 on its peripheral side resulting in relatively greater initial counterforce to the head as vertical compression of the top part occurs at an earlier stage together with earlier contact with slope of the roll or buttress, which in turn provides increasing counterforce towards the periphery (i.e. highest point of roll or buttress), in addition to the progressively increasing counterforce of the roll or buttress itself.

At the highest points $p^2$ only minimal horizontal plane stretch of the soft top part 10 occurs. The load results in virtually vertical compression only, which occurs at an earlier stage than a vertical load at say $p^1$. Counterforce to the weight of the head and neck is in addition offered at an earlier stage, in the region of $p^2$ compared to $p^1$ by the roll or buttress and to a greater degree by virtue of the greater material thickness at $p^2$ compared to $p^1$.

FIGS. 5B and 5C show how the top part functions above a minor recess region. The top part is of generally homogeneous material and adhered around the line joining points $p^2$ i.e. the top part is adhered around the periphery of the base part but not medial to a line joining the points $p^2$. An initial load applied to the top part at $c^1$ will tend to stretch the top part evenly in all directions. As the horizontally moving load nears $c^2$ (a minor recess) there will be a relatively greater counterforce by the top part, which will be maximal between $p^2$—$p^2$ as the top part is relatively fixed between those points and also to their outer aspects. This facilitates the cradling function of the top part which acts synergistically with the upper surface minor recess and buttress, followed by, as previously explained, obliteration of the lower surface minor recess towards, for example, the bed surface, together with progressive vertical compression of the base part components under load.

The top part 10 can be relatively thin to reduce the overall pillow to a size which will fit in a standard sized pillow case. The upper surface of part 10 retains its soft, smooth and relatively flat surface, essential to user comfort.

Having described how the pillow functions generally under load, specific examples of head and neck movements during sleep and the resultant pillow response will now be described and illustrated.

FIGS. 2A to 2C show how the pillow responds with a load at line F—F on the left side of FIG. 1A, the pillow viewed generally from the front.

FIG. 2A shows the unloaded state of the pillow with upper and lower voids 27 at the minor recesses 24 between the front roll and the front side buttress. FIG. 2B shows the first stage of load application causing compression and stretching of the top layer into the upper void 27. The third stage, shown in FIG. 2C, causes further stretching and compression of the top part 10, together with elimination of the lower void 27 and compression of the base part 11 in the recess area. Finally in FIG. 2D, a central load is shown, at line E—E of FIG. 1, the load causing compression and stretching of the top part 10 and compression of base part 11 front roll.

FIGS. 3A-3C show the functional relationships between the parts 10 and 11 with the pillow viewed from the side, the load being applied at line F—F. FIG. 3A shows the unstressed state, with the top part 10 under slight tension even when not under the load of the sleeper's head. FIG. 3B shows compression and stretching of top part to eliminate the void between front and side buttresses at front of pillow. As there is only adhesion of the parts 10 and 11 around their respective peripheries, then when the load is applied, stretching of the top layer can result over a wider area as the void immediately below the head is progressively eliminated. If the top part was mainly adhered to the recessed upper surface of part 11, the void areas would be eliminated prior to any load being applied. Application of load would result in compression of the top part in an axis at right angles to the surface. No significant stretching of the part 10 in its surface plane would occur. The consequences of this would be:

1) A significant proportion of the soft progressive cradling support would be lost as the load of the head would only have the counterforce of the top part immediately under the sleeper's head and would not have the additional counterforce of a wider area (and volume) of the top part material layer.

2) The top part upper surface would no longer be smooth as it would follow the contours of the recessed upper surface of part 11.

3) A thicker top part would be required to achieve a desirable degree of softness for the user. Practical consequences of this would be:

a) An undesirably thick and bulky pillow which would not fit within a conventional sized pillow case.

b) The increased thickness of the top part would result in a greater 'sinking in' in the area of the sleeper's head, which would impinge on the nose when the sleeper's head was turned sideways.

FIG. 3C shows the next stage of loading. Further compression and stretching of the top part occurs. The lower surface void in part 11 is eliminated. The front and side buttresses are now being compressed, including the recessed area between these. The combined effects are to provide progressive cradling and support for the head and neck.

Although illustrated for position F—F, the above principles apply equally to other areas of the pillow.

FIGS. 4B and 4C are similar to FIGS. 3A to 3C, but are sections along E—E. FIG. 4A shows the unstressed state of the pillow with upper and lower centre section voids 28. FIG. 4B shows the first stage of load application, where the top part begins compressing over the front roll 19 and being stretched to begin to fill upper void 28. FIG. 4C shows the final stage, with further compression of the top part. The upper void 28 is now almost eliminated, the base part front roll 19 is being compressed, and the lower void 28 is eliminated.

FIGS. 6A–6C show an alternative form of pillow of the invention, the difference being in relation to the base part, denoted here as 29, the top part again being denoted by numeral 10. This alternative base part has a recessed upper surface 30 and a non-recessed, flat lower surface 31. It also has less complex contours, thereby overcoming possible technical problems associated with practical limitations of moulding expertise in certain industrial areas or countries. It is known that many commercial moulders of soft polyurethane or latex prefer that one surface is substantially flat and that the perimeter dimensions are the maximum perimeter dimensions to be found in the product in any horizontal plane level.

The base part has front and rear rolls 32, 33 respectively, the front roll being bowed. A void 34 is formed between the recess in the upper surface 30 and the top part 10.

The overall depth of the base part is similar to that of the base part 11. As a result the upper recessed areas can be of relatively greater depth and so maintain the total volume of the void areas, such that the soft top part will stretch to the degree desired to facilitate compensation for the lack of a recessed surface on the base part underside, and its associated void areas.

We claim:

1. A pillow comprising:

a base part including front and rear rolls and an upper surface and a lower surface, said upper surface having a large central recessed area disposed between said rolls; and a top part having an upper surface, and a lower surface, said lower surface of said top part adhered to said upper surface of said base part; and at least one peripheral surface between said upper surface of the top part and said lower surface of the base part; and respective first buttress portions at opposite sides of said recessed area, said first buttress portions extending to said at least one peripheral surface; and a pair of second buttress portions each extending to said at least one peripheral surface disposed adjacent to, and at respective opposite sides of, one of the first buttress portions and being spaced therefrom by respective further recessed areas extending from said central recessed area; and a central void between said central recessed area and said lower surface of the top part in an undeformed state of the pillow, the whole of said upper surface of the top part being smooth, and said top part being of softer material than that of said base part.

2. A pillow as claimed in claim 1, wherein said further recessed areas extend to said at least one peripheral surface.

3. A pillow according to claim 1, wherein each first buttress portion has a pair of said second buttress portions disposed adjacent thereto at its opposite sides respectively, spaced therefrom by a respective pair of said further recessed areas.

4. A pillow according to claim 3, wherein between adjacent ones of the two pairs of said second buttress portions respectively are respective minor buttress portions.

5. A pillow according to claim 4, wherein between each minor buttress portion and an adjacent one of said second buttress portions is a minor recess area extending from said central recessed area to said at least one peripheral edge.

6. A pillow according to claim 1, wherein the boundary of each of said second buttress portions with said central recessed area is convex in the plane of the pillow.

7. A pillow according to claim 4, wherein each side or minor buttress portion is of tapering shape towards the central recessed area, reducing in width, in the plane of the pillow.

8. A pillow according to claim 7 in which the base part is symmetrical about a plane mid-way between its upper and lower surfaces.

9. A pillow according to claim 7, which is asymmetric about a plane mid-way between its upper and lower surfaces by virtue only of side buttress portions on the lower surface being less wide than side buttress portions on the upper surface respectively.

10. A pillow according to claim 4, wherein the top part and the base part are adhered together only around their respective peripheries, the adherence not exceeding centrally beyond the highest points of the front and rear rolls, said second buttress portions and said minor buttress portions.

11. A pillow of rectangular configuration, comprising:

a base part including front and rear rolls and an upper surface and a lower surface, said upper surface having a large central recessed area disposed between said rolls; and a top part having an upper surface, and a lower surface, said lower surface of said top part adhered to said upper surface of said base part; and at least one peripheral surface between said upper surface of the top part and said lower surface of the base part; and respective first buttress portions at opposite sides of said recessed area, said first buttress portions extending to said at least one peripheral surface; and a pair of second buttress portions each extending to said at least one peripheral surface disposed adjacent to, and at respective opposite sides of, one of the first buttress portions and being spaced therefrom by respective further recessed areas extending from said central recessed area; and a central void between said central recessed area and said lower surface of the top part in an undeformed state of the pillow, and longer front and rear peripheral surfaces, and shorter peripheral side surfaces, said first buttress portions being formed by said front and rear rolls respectively which define part of said front and rear peripheral surfaces respectively, each of said front and rear rolls also partly defining at its respective opposite ends said second buttress portions in the form of corner buttresses, each corner buttress being spaced from its adjacent first buttress portion by a further recessed area in the form of a minor recess, the whole of said upper surface of the top part being smooth, and said top part being of softer material than that of said base part.

12. A pillow according to claim 11, wherein respective side rolls of the base part partly define said shorter peripheral side surfaces and partly define said corner buttresses.

13. A pillow according to claim 12, wherein formed as part of said side rolls are respective minor or side buttress portions, each disposed centrally between corner buttresses of the front and rear rolls respectively.

14. A pillow according to claim 13, wherein between each side buttress portion and an adjacent corner buttress is a minor recess extending from said central recessed area to a side surface.

15. A pillow according to claim 11, wherein each of the front and rear rolls is of ovoid transverse cross-section.

16. A pillow according to claim 11, wherein the first buttress portions, the corner buttresses and the side buttress portions are all at the same height at the peripheral surfaces of the pillow and all slope towards the central recessed area.

17. A pillow comprising:

a base part having front and rear rolls and an upper surface and a lower surface, said upper surface having a large central recessed area disposed between said rolls, and a top part having an upper surface and a lower surface, said lower surface of said top part adhered to said upper surface of said base part, and at least one peripheral surface between said upper surface of the top part and said lower surface of the base part, and respective first buttress portions at opposite sides of said recessed area, said first buttress portions extending to said at least one peripheral surface, and a central void between said central recessed area and said lower surface of the top part in an undeformed state of the pillow, the boundary of each of the first buttress portions with said central recessed area being generally convex in the plane of the pillow, the whole of said upper surface of the top part being smooth, the top part being of a softer material than that of the base part.

18. A pillow comprising:

a base part having front and rear rolls and an upper surface and a lower surface, and a top part having an upper surface and a lower surface, said lower surface of said top part adhered to said upper surface of said base part, and central recessed areas in both the upper and lower surface of the base part respectively, the central recessed areas being at least partly overlapping relationship in a direction perpendicular to said surfaces, and at least one peripheral surface between said upper surface of the top part and said lower surface of the base part, and respective first buttress portions at opposite sides of said recessed area in the upper surface of the base part, said first buttress portions extending to said at least one peripheral surface, and a central void between said central recessed area in the upper surface of the base part and said lower surface of the top part in an undeformed state of the pillow, the whole of said upper surface of the top part being smooth, the top part being of a softer material than that of the base part.

19. A pillow comprising:

a base part having front and rear rolls and an upper surface and a lower surface, said upper surface having a large central recessed area disposed between said rolls, and a top part having an upper surface and a lower surface, said lower surface of said top part adhered to said upper surface of said base part, and a central void between said central recessed area and said lower surface of the top part in an undeformed state of the pillow, and respective first buttress portions on said base part upper and lower surfaces respectively, the lower first buttress portion being of shorter length than the upper first buttress portion, the whole of said upper surface of the top part being smooth, the top part being of a softer material than that of the base part.

20. A pillow comprising:

a base part having front and rear rolls and an upper surface and a lower surface, said upper surface having a large central recessed area disposed between said rolls, and a top part having an upper surface and a lower surface, said lower surface of said top part adhered to said upper surface of said base part, and at least one peripheral surface between said upper surface of the top part and said lower surface of the base part, and respective first buttress portions at opposite sides of said recessed area, said first buttress portions extending to said at least one peripheral surface, and a central void between said central recessed area and said lower surface of the top part in an undeformed state of the pillow, the whole of said upper surface of the top part being smooth, the top part of a softer material than that of the base part, said lower surface of said top part being flat, in said undeformed state of the pillow.

21. A pillow comprising:

non-identically shaped base and top parts, said base part having front and rear rolls and an upper surface and a lower surface, said top part having an upper surface and a lower surface, said upper surface of the top part and said lower surface of the base part respectively specifically defining upper and lower surface of the pillow in use, said upper surface of the base part having a large central recessed area, said recessed area being between said rolls, said lower surface of the top part being adhered to said upper surface of the base part, and at least one peripheral surface between said upper surface of the top part and said lower surface of the base part, and respective first buttress portions at opposite sides of said recessed area, said first buttress portions extending to said at least one peripheral surface, and a central void between said recessed area and said lower surface of the top part in an undeformed state of the pillow, the whole of said upper surface of the top part being smooth, and the top part being of a softer material than that of the base part.

* * * * *